US007438731B2

(12) United States Patent
Watanabe et al.

(10) Patent No.: US 7,438,731 B2
(45) Date of Patent: Oct. 21, 2008

(54) FUEL ADDITIVE COMPOSITION AND FUEL COMPOSITION CONTAINING THE SAME

(75) Inventors: Hiroshi Watanabe, Hamamatsu (JP); Satoshi Ohta, Shizuoka Prefecture (JP); Katsumi Umehara, Shizuoka Prefecture (JP)

(73) Assignee: ChevronTexaco Japan Limited (JP)

( * ) Notice: Subject to any disclaimer, the term of this patent is extended or adjusted under 35 U.S.C. 154(b) by 472 days.

(21) Appl. No.: 10/742,080

(22) Filed: Dec. 19, 2003

(65) Prior Publication Data

US 2004/0154218 A1 Aug. 12, 2004

(30) Foreign Application Priority Data

Jan. 6, 2003 (JP) ..... 2003-000632

(51) Int. Cl.
*C10L 1/18* (2006.01)
*C10L 1/22* (2006.01)

(52) U.S. Cl. ..... 44/418; 44/434; 44/443

(58) Field of Classification Search ..... 44/418, 44/434, 443
See application file for complete search history.

(56) References Cited

U.S. PATENT DOCUMENTS

| | | | | |
|---|---|---|---|---|
| 3,901,865 | A | 8/1975 | Polss | |
| 4,409,000 | A | 10/1983 | LeSuer | |
| 4,464,182 | A * | 8/1984 | Tack et al. | 44/393 |
| 6,086,645 | A * | 7/2000 | Quigley et al. | 44/418 |
| 6,203,584 | B1 * | 3/2001 | Fuentes-Afflick et al. | 44/387 |
| 6,562,086 | B1 * | 5/2003 | Gentry et al. | 44/418 |
| 6,786,939 | B2 * | 9/2004 | Hazel et al. | 44/388 |
| 6,835,217 | B1 * | 12/2004 | DeRosa et al. | 44/418 |
| 2002/0129541 | A1 | 9/2002 | Daly et al. | |

FOREIGN PATENT DOCUMENTS

| | | |
|---|---|---|
| EP | 0878532 | 11/1988 |
| EP | 0654524 | 5/1995 |
| EP | 0 869 163 A1 | 10/1998 |
| WO | WO 98/17745 | 4/1998 |
| WO | WO 98/17746 | 4/1998 |

* cited by examiner

*Primary Examiner*—Cephia D Toomer
(74) *Attorney, Agent, or Firm*—Steven G. K. Lee; Joseph P. Foley; Claude J. Caroli

(57) ABSTRACT

A fuel additive composition containing at least one amide compound selected from the group consisting of a fatty acid alkanol amide and a hydrocarbyl amide, a polyalkylene-oxide, and a friction modifier. The fuel additive composition is surprisingly useful for improving the acceleration response and the driving performance of vehicles having internal combustion engines when used as fuel additives in hydrocarbon-based fuels, such as gasoline fuel or diesel fuel.

8 Claims, No Drawings

FUEL ADDITIVE COMPOSITION AND FUEL COMPOSITION CONTAINING THE SAME

CROSS REFERENCE TO RELATED APPLICATIONS

This application claims priority from Japanese Patent Application Number 2003-000632, filed Jan. 6, 2003.

The present invention relates to a fuel additive composition. In a further aspect the present invention relates to the use of such fuel additive compositions in a hydrocarbon-based fuel, such as gasoline fuel or diesel fuel, to enhance the acceleration response and the driving performance of vehicles having internal combustion engines, such as gasoline or diesel engines.

BACKGROUND OF THE INVENTION

In order to increase engine output power and acceleration response of spark ignition engines in automobiles, oxygen-containing additives such as alcohols (e.g., methanol, ethanol), ethers (e.g., methyl-t-butyl ether) and ketones (e.g., acetone) have been studied. Further, as additives of fuel for automobile racing, hydrozine and nitro compounds (e.g., nitroparaffins such as nitromethane and nitropropane, nitrobenzene) have been investigated. Those additives, however, often give adverse effects to the engine and its components.

It is also known that organometallic compounds (e.g., ferrocene, methylcyclopentadienyl manganese tricarbonyl, alkyl lead such as tetraethyl lead) and aromatic amines (e.g., aniline, monomethyl aniline and dimethyl aniline) can be used as anti-knocking agents. However, it has been confirmed that those compounds poison three-way catalysts of catalytic converters for treating the exhaust gas and consequently that they reduce the catalysis efficiency. Japanese Patent Provisional Publication No. 58-104996 (corresponding to U.S. Pat. No. 4,409,000) describes that carburetors and engines can be cleaned by adding alkyl amine or ethylene oxide-adducted alkenyl amine into automobile fuel.

European Patent No. 869163 A1 describes that the addition of N,N-bis(hydroxyalkyl)alkylamine to gasoline reduces friction of gasoline engines.

According to PCT Patent Publication No. 2001-502374 (WO-98/17746), solubility in water as well as engine performance can be improved by adding fatty acid diethanol amide, alcohol ethoxylate or fatty acid ethoxylate into liquid fuel such as gasoline or diesel fuel.

It is an object of the present invention to provide a fuel additive composition which is added into a fuel such as gasoline to improve driving performance, in particular, acceleration performance of automobiles without giving any adverse effect to the internal combustion engines.

It is another object of the present invention to provide an automobile fuel, such as gasoline, containing the above fuel additive composition.

SUMMARY OF THE INVENTION

The present invention relates to a fuel additive composition. In a further aspect the present invention relates to the use of such fuel additive compositions in a hydrocarbon-based fuel, such as gasoline fuel or diesel fuel, to enhance the acceleration response and the driving performance of vehicles having internal combustion engines, such as gasoline or diesel engines.

In its broadest aspect, the present invention relates to a fuel additive composition comprising at least one amide compound selected from the group consisting of a fatty acid alkanol amide and a hydrocarbyl amide, and a polyalkylene-oxide. The fuel additive composition may further comprise a friction modifier.

In another aspect, the present invention relates to a fuel composition comprising a major amount of hydrocarbon fuels boiling in the gasoline or diesel range and a minor amount, typically from about 5 to 5,000 ppm weight per weight of fuel, of each of the components of the fuel additive composition of the present invention. The fuel composition may further comprise a friction modifier.

In still another aspect, the present invention relates to a method of improving the acceleration performance of vehicles having gasoline or diesel engines comprising operating the vehicle with the fuel composition of the present invention.

Among other factors, the present invention is based on the discovery that a certain combination of at least one amide compound selected from the group consisting of a fatty acid alkanol amide and a hydrocarbyl amide, and a polyalkylene-oxide is surprisingly useful for improving the acceleration response and the driving performance of vehicles having internal combustion engines when used as fuel additives in hydrocarbon-based fuels, such as gasoline fuel or diesel fuel. Further, if an automobile is driven using a gasoline containing the fuel additive composition of the present invention, the fuel efficiency increases, the engine rotation during idling stabilizes, and vibration of the engine and noise decreases. Moreover, engine output increases.

DETAILED DESCRIPTION OF THE INVENTION

As stated above, the present invention relates to a fuel additive composition containing at least one amide compound selected from the group consisting of a fatty acid alkanol amide and a hydrocarbyl amide, and a polyalkylene-oxide and the use of such fuel additive compositions in a hydrocarbon-based fuel, such as gasoline fuel or diesel fuel.

Prior to discussing the present invention in detail, the following terms will have the following meanings unless expressly stated to the contrary.

Definitions

The term "amino" refers to the group: —$NH_2$.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "polyalkyl" refers to alkyl groups which are generally derived from polyolefins which are polymers or copolymers of mono-olefins, particularly 1-mono-olefins, such as ethylene, propylene, butylene, and the like. Preferably, the mono-olefin employed will have from about 2 to 24 carbon atoms, and more preferably, from about 3 to 12 carbon atoms. More preferred mono-olefins include propylene, butylene, particularly isobutylene, 1-octene, and 1-decene. Polyolefins prepared from such mono-olefins include polypropylene, polybutene, especially polyisobutene, and the polyalphaolefins produced from 1-octene and 1-decene.

The term "alkenyl" refers to an alkyl group with unsaturation.

The term "alkylene oxide" refers to a compound having the formula:

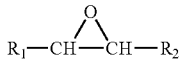

wherein $R_1$ and $R_2$ are each independently hydrogen or lower alkyl having from 1 to about 6 carbon atoms.

The term "fuel" or "hydrocarbon-based fuel" refers to normally liquid hydrocarbons having boiling points in the range of gasoline and diesel fuels.

The Amide Compound

The amide component employed in the fuel additive composition of the present invention is at least one amide compound selected from the group consisting of a fatty acid alkanol amide and a hydrocarbyl amide as further described herein below.

The amount of the amide compound in a hydrocarbon-based fuel will typically be in a range of from about 5 to 5,000 ppm by weight per weight (active component ratio). Preferably, the desired range is from about 5 to 3,000 ppm by weight, and more preferably a range of from about 5 to 1,000 ppm by weight, based on the total weight of the fuel composition.

The Fatty Acid Alkanol Amide

The fatty acid alkanol amide employed in the fuel additive composition of the present invention is typically the reaction product of a $C_4$ to $C_{75}$, preferably $C_6$ to $C_{30}$, more preferably $C_8$ to $C_{22}$, fatty acid or ester, and a mono- or di-hydroxy hydrocarbyl amine, wherein the fatty acid alkanol amide will typically have the following formula:

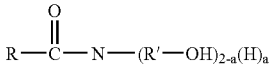

wherein

R is a hydrocarbyl group having from about 4 to 75, preferably from about 6 to 30, most preferably from about 8 to 22, carbon atoms;

R' is a divalent alkylene group having from 1 to about 10, preferably from 1 to about 6, more preferably from about 2 to 5, most preferably from about 2 to 3, carbon atoms; and a is an integer from about 0 to 1. Preferably, a is 0.

The acid moiety may preferably be RCO— wherein R is preferably an alkyl or alkenyl hydrocarbon group containing from about 4 to 75, preferably from about 5 to 19, carbon atoms typified by caprylic, caproic, capric, lauric, myristic, palmitic, stearic, oleic, linoleic, etc. Preferably the acid is saturated although unsaturated acid may be present.

Preferably, the reactant bearing the acid moiety may be natural oil: coconut, babassu, palm kernel, palm, olive, castor, peanut, rape, beef tallow, lard, lard oil, whale blubber, sunflower, etc. Typically the oils which may be employed will contain several acid moieties, the number and type varying with the source of the oil.

The acid moiety may be supplied in a fully esterified compound or one which is less than fully esterified, e.g., glyceryl tri-stearate, glyceryl di-laurate, glyceryl mono-oleate, etc. Esters of polyols, including diols and polyalkylene glycols may be employed such as esters of mannitol, sorbitol, pentaerythritol, polyoxyethylene polyol, etc.

A mono- or di-hydroxy hydrocarbyl amine with a primary or secondary amine nitrogen may be reacted to form the fatty acid alkanols amides employed in the fuel additive of the present invention. Typically, the mono- or di-hydroxy hydrocarbyl amines may be characterized by the formula:

$$HN(R'OH)_{2-b}H_b$$

wherein R' is as defined above and b is 0 or 1.

Typical amines may include, but are not limited to, ethanolamine, diethanolamine, propanolamine, isopropanolamine, dipropanolamine, di-isopropanolamine, butanolamines etc.

Reaction may be effected by heating the oil containing the acid moiety and the amine in equivalent quantities to produce the desired product. Reaction may typically be effected by maintaining the reactants at about 100° C. to 200° C., preferably about 120° C. to 150° C. for 1 to about 10 hours, preferably about 4 hours. Reaction may be carried out in a solvent, preferably one which is compatible with the ultimate composition in which the product is to be used.

Typical reaction products which may be employed in the practice of the present invention may include those formed from esters having the following acid moieties and alkanolamines:

| Acid Moiety in Ester | Amine |
|---|---|
| Lauric Acid | propanolamine |
| Lauric Acid | diethanolamine |
| Lauric Acid | ethanolamine |
| Lauric Acid | dipropanolamine |
| Palmitic Acid | diethanolamine |
| Palmitic Acid | ethanolamine |
| Stearic Acid | diethanolamine |
| Stearic Acid | ethanolamine |

Other useful mixed reaction products with alkanolamines may be formed from the acid component of the following oils: coconut, babassu, palm kernel, palm, olive, castor, peanut, rape, beef tallow, lard, whale blubber, corn, tall, cottonseed, etc.

In one preferred aspect of the present invention, the desired reaction product may be prepared by the reaction of (i) a fatty acid ester of a polyhydroxy compound (wherein some or all of the OH groups are esterified) and (ii) diethanolamine.

Typical fatty acid esters may include esters of the fatty acids containing from about 6 to 20, preferably from about 8 to 16, more preferably about 12, carbon atoms. These acids may be characterized by the formula RCOOH wherein R is an alkyl hydrocarbon group containing from about 7 to 15, preferably from about 11 to 13, more preferably about 11 carbon atoms.

Typical of the fatty acid esters which may be employed may be glyceryl tri-laurate, glyceryl tri-stearate, glyceryl tri-palmitate, glyceryl di-laurate, glyceryl mono-stearate, ethylene glycol di-laurate, pentaerythritol tetra-stearate, pentaerythritol tri-laurate, sorbitol mono-palmitate, sorbitol penta-stearate, propylene glycol mono-stearate.

The esters may include those wherein the acid moiety is a mixture as is typified by the following natural oils: coconut, babassu, palm kernel, palm, olive, caster, peanut, rape, beef tallow, lard (leaf), lard oil, whale blubber.

The preferred ester is coconut oil which contains the following acid moieties:

| Fatty Acid Moiety | Wt. % |
|---|---|
| Caprylic | 8.0 |
| Capric | 7.0 |
| Lauric | 48.0 |
| Myristic | 17.5 |
| Palmitic | 8.2 |
| Stearic | 2.0 |
| Oleic | 6.0 |
| Linoleic | 2.5 |

Examples of desirable alkyl amides suitable for the present invention include, but are not limited to, octyl amide (capryl amide), nonyl amide, decyl amide (caprin amide), undecyl amide dodecyl amide (lauryl amide), tridecyl amide, teradecyl amide (myristyl amide), pentadecyl amide, hexadecyl amide (palmityl amide), heptadecyl amide, octadecyl amide (stearyl amide), nonadecyl amide, eicosyl amide (alkyl amide), or docosyl amide (behenyl amide). Examples of desirable alkenyl amides include, but are not limited to, palmitoolein amide, oleyl amide, isooleyl amide, elaidyl amide, linolyl amide, linoleyl amide. Preferably, the alkyl or alkenyl amide is a coconut oil fatty acid amide.

The preparation of hydrocarbyl amides from fatty acid esters and alkanolamines is described, for example, in U.S. Pat. No. 4,729,769 to Schlicht et al., the disclosure of which is incorporated herein by reference.

The Hydrocarbyl Amide

The hydrocarbyl amide employed in the fuel additive composition of the present invention will typically have the following structure:

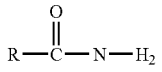

wherein R is a hydrocarbyl group having from about 6 to 30 carbon atoms.

The hydrocarbyl amide is preferably an alkyl amide having from about 7 to 31 carbon atoms or an alkenyl amide having one or two unsaturated groups and from about 7 to 31 carbon atoms. Preferred examples of the alkyl amide include octane amide (capryl amide), nonane amide, decane amide (caprin amide), undecane amide, dodecane amide (lauryl amide), tridecane amide, tetradecane amide (myristyl amide), pentadecane amide, hexadecane amide (palmityl amide), heptadecane amide, octadecane amide (stearyl amide), nanodecane amide, eicosane amide (aralkyl amide), and docosane amide (behenyl amide). Preferred examples of the alkenyl amide include palmitolein amide, oleyl amide, isooleyl amide, elaidyl amide, linolyl amide, and linoleyl amide.

The hydrocarbyl amide employed in the fuel additive composition of the present invention is typically the reaction product of a $C_7$ to $C_{31}$ fatty acid or ester and ammonia.

The Polyalkylene-Oxide

The polyalkylene-oxide employed in the fuel additive composition of the present invention is derived from an alkylene oxide wherein the alkylene group has from about 2 to 5 carbon atoms. Preferably, the polyalkylene-oxide is an oligomer or polymer of an alkylene oxide selected from the group consisting of ethylene oxide, propylene oxide, butylene oxide, and pentylene oxide. Ethylene oxide and propylene oxide are particularly preferred. In addition, mixtures of alkylene oxides are desirable in which, for example, a mixture of ethylene oxide and propylene oxide may be used. A respective molar ratio of from about 1:5 to 5:1 may be used in the case of a mixture of ethylene oxide and propylene oxide. The polyalkylene-oxide may also be end-capped with an ether or ester function to give, for example, a mono-alkoxy polyalkylene-oxide, such as n-butoxy polypropylene glycol.

A desirable number of moles of the polyalkylene-oxide will be in the range of from about 3 to 50 moles of alkylene oxide per 1 mole of hydrocarbyl amide. More preferably, the range of from about 3 to 20 moles is particularly desirable. Most preferably, the range of from about 4 to 15 moles is most preferable.

The amount of polyalkylene-oxide added in a hydrocarbon-based fuel will typically be in a range of from about 5 to 5,000 ppm by weight per weight (active component ratio). Preferably, the desired range is from about 5 to 3,000 ppm by weight, and more preferably a range of from about 5 to 1,000 ppm by weight, based on the total weight of the fuel composition.

In the fuel additive composition of the present invention, the amide compound and the polyalkylene-oxide are preferably employed in a weight ratio of from about 5:95 to 95:5, more preferably from about 80:20 to 20:80.

The Friction Modifier

The fuel additive composition of the present invention may further comprise an organic friction modifier in addition to the amide compound and polyalkylene-oxide. The organic friction modifier may be selected from the group consisting of a fatty acid, an aliphatic amine, a polyhydric aliphatic alcohol, an aliphatic ester, and an aliphatic ether. The friction modifier can be employed singly or in combination in addition to the amide compound and polyalkylene-oxide.

Preferred examples of the fatty acids include an aliphatic monocarboxylic acid and an oligomer of an unsaturated aliphatic monocarboxylic acid. Examples of the aliphatic monocarboxylic acids include saturated or unsaturated aliphatic monocarboxylic acid having from about 3 to 31 carbon atoms, such as myristic acid, palmitic acid, stearic acid, oleic acid, linolic acid, and linoleic acid. Examples of the oligomers of an unsaturated aliphatic monocarboxylic acid include dimers of unsaturated aliphatic monocarboxylic acids having from about 7 to 31 carbon atoms, such as acrylic acid, oleic acid, linolic acid, and linoleic acid. The aliphatic group can be linear or branched. The branched aliphatic group is preferred. The aliphatic group can have a substituent such as hydroxyl or an alkoxy.

Preferred examples of the aliphatic amines include aliphatic monoamines having from about 7 to 31 carbon atoms such as palmityl amine, stearyl amine, oleyl amine, and linoleyl amine, and aliphatic monoamine derivatives such as an aliphatic monoamine having a hydroxyl group or an alkoxy group on its aliphatic chain.

Preferred examples of the polyhydric aliphatic alcohols include linear or branched polyhydric aliphatic alcohols having from about 7 to 31 carbon atoms such as 1,2-decanediol, 1,2-dodecanediol, 1,2-tetradecanediol, 1,2-hexadecanediol, 1,2-octadecanediol, and 1,2-eicosanediol. The linear polyhydric aliphatic alcohols are more preferred.

Preferred examples of the aliphatic esters include esters of linear or branched monohydric or polyhydric aliphatic alcohols and fatty acids such as glycerol monooleate. The esters of linear monohydric or polyhydric aliphatic alcohols are more preferred.

Preferred examples of the aliphatic ethers include ethers of linear or branched aliphatic alcohols having from about 7 to 31 carbon atoms and monohydric or polyhydric aliphatic alcohols having from about 7 to 31 carbon atoms such as oleyl glycerol ether. The ethers of linear aliphatic alcohols are more preferred.

If the fuel additive composition of the present invention is added in a low-boiling point hydrocarbon fuel (i.e., gasoline), the acceleration performance is remarkably improved. Further, even if the fuel additive composition is added in other fuels such as diesel fuels, alcohol fuels, ether fuels and various mixed fuels, the driving performance is improved.

Recently, the sulfur content in gasoline and diesel fuel has been decreased. For instance, the sulfur content in gasoline has been decreased to 50 ppm or less, further 100 ppm or less. The fuel additive composition of the invention is effective even if it is incorporated into such low sulfur gasoline. Further, the fuel additive composition of the present invention functions favorably even if it is incorporated into a gasoline having a low Reid vapor pressure (RVP) of 65 kPa or lower than 60 kPa. Furthermore, the fuel additive composition of the present invention is effective even if it is incorporated into a low sulfur diesel fuel having a low sulfur content of 100 ppm or less.

The friction modifier is added to the fuel generally in an amount of from about 10 to 10,000 ppm by weight (active component ratio), preferably in an amount of from about 10 to 5,000 ppm by weight. The amount of the friction modifier is preferably employed in an amount of from about 0.01 to 10 weight parts, per one weight part of the amide compound.

The fuel additive composition of the present invention is generally used in the form of an organic solvent solution containing the active component in an amount of 30 wt. % or more. This addition amount is based on the active components.

There is no particular limitation on the method for adding the fuel additive composition into fuel, but generally a concentrated fuel additive solution containing the additive composition in an amount of 30 wt. % or more is prepared and poured into a fuel tank of gas station or into a fuel tank of car. The amide compound, polyalkylene-oxide, and the friction modifier can be simultaneously or sequentially incorporated into the fuel.

The fuel additive composition of the present invention can be used in combination with one or more known fuel additives. Such additives include, but are not limited to, deposit control additives such as detergents or dispersants, corrosion inhibitors, oxidation inhibitors, metal deactivators, demulsifiers, static electricity preventing agents, anti-coagulation agents, anti-knock agents, oxygenates, flow improvers, pour point depressants, cetane improvers and auxiliary-solution agents.

Diesel fuels will typically contain various additives in conventional amounts. The additives include cold flow improvers, pour point depressants, storage stabilizers, corrosion inhibitors, anti-static agents, biocidal additives, combustion modifiers or smoke suppressants, dyes, and deodorants. Examples of such additives are known to the art as well as to the literature. Accordingly, only a few additives will be discussed in detail. Considering the storage stabilizers, they can include various antioxidants which prevent the accumulation of organic peroxides such as hindered phenols, N,N,-dialkyl paraphenylene diamines, paraamino phenols and the like. Color stabilizers constitute another group with specific examples including tertiary amines, secondary amines, imidazolines, tertiary alkyl primary amines, and the like. Another storage stabilizer group are the various metal deactivators for metals which serve as catalysts for oxidation during storage. Yet other storage stabilizers are the various dispersants which keep gummy, insoluble residues and other solids dispersed as small particles so that they do not interfere with the proper burning of the fuel. Such compounds can be oil soluble ethoxylated alkyl phenols, polyisobutylene alkylated succinimides, polyglycol esters of alkylated succinic anhydrides, and the like.

Considering the corrosion inhibitors which generally retard the effects of oxygen and/or water, they are generally polar organic molecules which form a monomolecular protective layer over metal surfaces. Chemically, such corrosion inhibitors fall into three general classes: (1) complex carboxylic acids or their salts, (2) organic phosphorus acids and their salts, and (3) ammonium mahogany sulfonates.

Combustion modifiers for diesel fuel have been found to suppress the formation of black smoke, that is, unburned carbon particles, in the diesel engine. These additives are believed to not only catalyze the burning of carbon particles to $CO_2$, but also to suppress the formation of free carbon in the early stages of the combustion cycle. Generally, two different types of chemicals are effective in suppressing diesel smoke. The first type comprises barium and calcium salts in amine or sulfonate complexes while the other type consists of metal alkyls of transition elements such as manganese, iron, cobalt, nickel, and the like.

Amounts of the various fuel additives in the fuel can vary over a considerable range. Generally, a suitable amount of a diesel fuel stabilizer is from about 3 to 300 ppm. A suitable amount of a corrosion inhibitor is from 1 to about 100 ppm with a suitable amount of a smoke suppressant being from about 100 to 5,000 ppm. Naturally, higher or lower amounts can be utilized depending upon the type of fuel, the type of diesel engine, and the like.

Diesel fuels may also contain various sulfur-free and sulfur-containing cetane improvers. Desirably, the sulfur-free compounds are nitrate cetane improvers which are known to the art as well as to the literature. For example, a description of such nitrate cetane improvers are set forth in U.S. Pat. Nos. 2,493,284; 4,398,505; 2,226,298; 2,877,749; 3,380,815; an article "Means of Improving Ignition Quality of Diesel Fuels" by Nygarrd et al, J. Inst. Petroleum, 27, 348-368 (1941); an article "Preflame Reactions in Diesel Engines", Part 1, by Gardner et al, The Institute of Petroleum, Vol. 38, 341, May, 1952; and an article "Ignition Accelerators for Compression-ignition Fuels" by Bogen et al, Petroleum Refiner 23, (7) 118-52 (1944), which are hereby fully incorporated by reference with regard to various types of nitrate cetane improvers.

Generally, the cetane improvers are alkyl nitrates having from 1 to about 18 carbon atoms and desirably from about 2 to 13 carbon atoms. Examples of specific nitrate cetane improvers include ethyl nitrate, butyl nitrate, amyl nitrate, 2-ethylhexyl nitrate, polyglycol dinitrate, and the like. Amyl nitrate and 2-ethylhexyl nitrate are preferred. Sulfur-containing cetane improvers are described, for example, in U.S. Pat. No. 4,943,303. Combinations of sulfur-containing cetane improvers with sulfur-free cetane improvers, such as nitrate cetane improvers, may also be employed in diesel fuels.

A fuel-soluble, nonvolatile carrier fluid or oil may also be used with the fuel additive composition of the present invention. The carrier fluid is a chemically inert hydrocarbon-soluble liquid vehicle which substantially increases the non-volatile residue (NVR), or solvent-free liquid fraction of the fuel composition while not overwhelmingly contributing to octane requirement increase. The carrier fluid may be natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Pat. Application Nos. 356,726 and 382,159, published Mar. 7, 1990 and Aug. 16, 1990, respectively.

Examples of the detergents employable in combination with the fuel additive composition of the present invention include dodecylphenyl polyoxybutylene-ethylenediamine carbamate, a composition of polyisobutenyl-ethyleneamine and doecylphenylpolyoxybutylenemonool, dodecylphenylpolyoxybutylene-monamine, a composition of p-aminobenzoate ester of polyisobutenylphenol-ethylene carbonate and monobutyl ether of polyoxypropylene glycol, and a composition of dodecylphenylpolyoxybutylenemonoamine and p-aminobenzoate ester of polyisobutenylphenolethylene carbonate. The detergent can be added to the fuel generally in an amount of from about 10 to 300 mg/L (ppm).

The present invention provides a method of operating gasoline engine automobiles wherein an automobile equipped with a gasoline engine is operated with the fuel composition of the present invention. The method of operating gasoline engine automobiles is preferred when the amount of alkylene oxide is from about 3 to 20 moles per mole of hydrocarbyl amide and the alkylene oxide is selected from the group consisting of ethylene oxide, propylene oxide, butylene oxide, pentylene oxide, or mixtures thereof.

The present invention further provides a method of improving the driving and acceleration performance of vehicles having internal combustion engines, such as a gasoline or diesel engines in automobiles, by using the fuel composition described herein.

The fuel additive composition of the present invention improves the acceleration performance of vehicles having internal combustion engines when the fuel additive composition is added to low boiling point hydrocarbon-based fuels like gasoline, and the driving performance is also improved when the fuel additive composition is added to other hydrocarbon-based fuels like a diesel fuel, alcohol fuel or ether fuel. The method of improving acceleration performance in gasoline engine automobiles is preferred when the amount of alkylene oxide is from about 3 to 20 moles per mole of hydrocarbyl amide and the alkylene oxide is selected from the group consisting of ethylene oxide, propylene oxide, butylene oxide, pentylene oxide, or mixtures thereof.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Example 1

A fuel composition containing a fuel additive composition of the present invention was prepared as follows.

The gasoline used had the following specifications: density (at 15° C.): 0.7389 g/cm$^3$, Reid vapor pressure: 60.5 KPa, octane numbers: 90.2 (RON), 82.3 (MON), aromatic content (vol. %): 29.9, olefin content (vol. %): 15.6, 10% distillation temperature (° C): 50.0, 50% distillation temperature (° C): 92.0, and 90% distillation temperature (° C): 169.5. To the gasoline, diethanolamide of coconut oil fatty acid was added in the amount of 55 mg/L (ppm). Further, polypropylene glycol ($C_4H_9O$—($CH_2CH(CH_3)$—O)$_n$—H, weight average molecular weight: 1,200) was added in the amount of 45 mg/L (ppm).

Comparative Example A

Comparative Example A was prepared with gasoline as described in Example 1 without containing the fuel additive composition of the present invention.

Gasoline containing the above described fuel additive composition (Example 1) and gasoline without the fuel additive composition (Comparative Example A) were then tested in accordance with the test procedures described herein below.

A Toyota Camry 1800 cc, 5MT (Type E-SV40, provided with Knock Sensor, type 4S-FE engine) was mounted on a chassis dynamometer, and operated at a constant speed of 20 km/hr. The throttle was then fully opened, and the time required for increasing the speed to 110 km/hr was measured. This measurement was repeated 10 times in the same condition, and the average time was determined as the acceleration time period. In order to minimize the influence of ambient conditions (temperature, pressure, etc.) on engine performance, all the tests were sequentially carried out in a single day. The results are set forth in Table 1.

TABLE 1

| Tested fuel | Acceleration time period (10-50 km/hr) |
|---|---|
| Gasoline without additive (Comparative Example A) | 10.13 seconds |
| Fuel composition containing the additive composition (Example 1) | 9.93 seconds |

From the difference between the acceleration time periods shown in Table 1, it is clear that the fuel additive composition of the present invention improved the acceleration performance. The difference in acceleration time shown in Table 1 is about 2%, which is a significant difference, particularly in the case of cars needing to attain a high speed, such as racing cars, etc. In addition to that case, even a small improvement in acceleration performance is very important for cars driving on public roads such as freeways in the case where the cars must accelerate rapidly enough to avoid an accident, etc, as a result of a sudden event.

What is claimed is:

1. A gasoline fuel composition for improving engine performance comprising a major amount of hydrocarbon fuels boiling in the gasoline range, and a minor amount of a fuel additive composition comprising at least one amide compound selected from the group consisting of a fatty acid alkanol amide and a hydrocarbyl amide, a polyalkylene-oxide, and a friction modifier, wherein the amount of each of the amide compound and the polyalkylene-oxide is in the range of from about 5 to 5,000 ppm by weight based on the total amount of the fuel composition; wherein the friction modifier is an oligomer of an unsaturated aliphatic monocarboxylic acid, in an amount of the range of from about 10 to 10,000 ppm by weight based on the amount of the fuel.

2. A method of improving the acceleration performance of a vehicle having a gasoline engine comprising operating the vehicle with a fuel composition comprising a major amount of hydrocarbon fuels boiling in the gasoline range, and a minor amount of a fuel additive composition comprising at least one amide compound selected from the group consisting of a fatty acid alkanol amide and a hydrocarbyl amide, a polyalkylene-oxide, and a friction modifier, wherein the amount of each of the amide compound and the polyalkylene-oxide is in the range of from about 5 to 5,000 ppm by weight based on the amount of the gasoline; wherein the friction modifier is an oligomer of an unsaturated aliphatic monocarboxylic acid, in an amount of the range of from about 10 to 10,000 ppm by weight based on the amount of the gasoline.

3. The gasoline fuel composition according to claim 1, wherein the polyalkylene-oxide is an oligomer prepared from about 3 to 50 moles of an alkylene oxide.

4. The gasoline fuel composition according to claim 1, wherein the amide compound and the polyalkylene-oxide are comprised in a ratio by weight of from about 5:95 to 95:5.

5. The gasoline fuel composition according to claim 1, wherein the polyalkylene-oxide is an oligomer of ethylene oxide, propylene oxide, butylene oxide, or a mixture thereof.

6. The gasoline fuel composition according to claim 1, wherein the fatty acid alkanol amide is the reaction product of a $C_4$ to $C_{75}$ fatty acid or ester and a mono- or di-hydroxy hydrocarbyl amine.

7. The gasoline fuel composition according to claim 1, wherein the hydrocarbyl amide is the reaction product of a $C_7$ to $C_{31}$ fatty acid or ester and ammonia.

8. The gasoline fuel composition according to claim 1, wherein friction modifier is a dimer of an unsaturated aliphatic monocarboxylic acid having from 7 to 31 carbon atoms.

* * * * *